US008918237B2

(12) United States Patent
Morris

(10) Patent No.: US 8,918,237 B2
(45) Date of Patent: Dec. 23, 2014

(54) TRAIN INTEGRITY AND END OF TRAIN LOCATION VIA RF RANGING

(71) Applicant: Lockheed Martin Corporation, Bethesda, MD (US)

(72) Inventor: Charles W. Morris, Nokesville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/839,507

(22) Filed: Mar. 15, 2013

(65) Prior Publication Data

US 2014/0277859 A1 Sep. 18, 2014

(51) Int. Cl.
*B61L 23/34* (2006.01)
*B61L 25/02* (2006.01)

(52) U.S. Cl.
CPC *B16L 23/34* (2013.01); *B61L 25/02* (2013.01)
USPC ..... 701/19

(58) Field of Classification Search
None
See application file for complete search history.

(56) References Cited

U.S. PATENT DOCUMENTS

| | | | | |
|---|---|---|---|---|
| 3,273,145 | A * | 9/1966 | Joy et al. | 342/52 |
| 3,641,338 | A | 2/1972 | Peel et al. | |
| 4,582,280 | A | 4/1986 | Nichols et al. | |
| 5,129,605 | A | 7/1992 | Burns et al. | |
| 5,757,291 | A | 5/1998 | Kull | |
| 5,893,043 | A | 4/1999 | Moehlenbrink et al. | |
| 6,081,769 | A | 6/2000 | Curtis | |
| 6,218,961 | B1 | 4/2001 | Gross et al. | |
| 6,295,019 | B1 * | 9/2001 | Richards et al. | 342/125 |
| 6,580,976 | B1 | 6/2003 | Belcea | |
| 6,865,454 | B2 * | 3/2005 | Kane et al. | 701/19 |
| 7,092,801 | B2 | 8/2006 | Kane et al. | |
| 7,096,096 | B2 | 8/2006 | Kane et al. | |
| 7,162,337 | B2 | 1/2007 | Peltz et al. | |
| 7,222,003 | B2 * | 5/2007 | Stull et al. | 701/19 |
| 7,395,141 | B1 | 7/2008 | Seck et al. | |
| 7,467,032 | B2 * | 12/2008 | Kane et al. | 701/19 |

(Continued)

FOREIGN PATENT DOCUMENTS

DE 19628124 1/1998

OTHER PUBLICATIONS

Rudi de Buda, "Coherent Demodulation of Frequency-Shift Keying With Low Deviation Ratio", Jun. 1972, IEEE Communications Society, IEEE Transactions on Communication, pp. 429-435.*

(Continued)

*Primary Examiner* — John R Olszewski
*Assistant Examiner* — David Merlino
(74) *Attorney, Agent, or Firm* — Hamre, Schumann, Mueller & Larson, P.C.

(57) ABSTRACT

Systems and methods that can be used in a Positive Train Control system to continuously monitor train integrity and end of train location using radio frequency (RF) ranging techniques to determine the line of sight distance between the head end and the end of the train. The systems and methods allow PTC controlled trains to maintain positive length of train awareness and to determine if a portion of the train separates unintentionally. The systems and methods can be implemented on existing RF infrastructure used on trains, without impacting existing messaging traffic, adding bandwidth or power requirements. The systems and methods work on stretched trains running on tangent or straight track, as well as on foreshortened trains running on curved track.

18 Claims, 6 Drawing Sheets

(56) References Cited

U.S. PATENT DOCUMENTS

| | | | | |
|---|---|---|---|---|
| 7,610,152 | B2 | 10/2009 | Meyer | |
| 7,733,239 | B2 * | 6/2010 | Nordmeyer | 342/125 |
| 7,742,850 | B2 * | 6/2010 | Kane et al. | 701/19 |
| 7,986,270 | B2 * | 7/2011 | Heidari-Bateni et al. | 342/387 |
| 8,279,111 | B2 * | 10/2012 | Zhen et al. | 342/125 |
| 8,334,801 | B2 * | 12/2012 | Fretenburg et al. | 342/125 |
| 2002/0049520 | A1 * | 4/2002 | Mays | 701/19 |
| 2005/0002481 | A1 * | 1/2005 | Woo et al. | 375/354 |
| 2005/0004722 | A1 * | 1/2005 | Kane et al. | 701/19 |
| 2005/0107954 | A1 | 5/2005 | Nahla | |
| 2005/0240322 | A1 | 10/2005 | Peltz et al. | |
| 2007/0233335 | A1 | 10/2007 | Kumar et al. | |
| 2008/0097659 | A1 | 4/2008 | Hawthorne | |
| 2008/0128562 | A1 | 6/2008 | Kumar et al. | |
| 2008/0167767 | A1 | 7/2008 | Brooks et al. | |
| 2008/0195265 | A1 | 8/2008 | Searle et al. | |
| 2008/0243320 | A1 * | 10/2008 | Otsubo et al. | 701/19 |
| 2008/0312775 | A1 | 12/2008 | Kumar | |
| 2009/0017782 | A1 | 1/2009 | Monat et al. | |
| 2009/0043435 | A1 | 2/2009 | Kane et al. | |
| 2009/0090818 | A1 | 4/2009 | Kumar | |
| 2009/0174594 | A1 * | 7/2009 | Thomas et al. | 342/94 |
| 2009/0177344 | A1 | 7/2009 | James et al. | |
| 2009/0186325 | A1 | 7/2009 | Kumar | |
| 2010/0235020 | A1 | 9/2010 | Meyer et al. | |
| 2011/0251742 | A1 * | 10/2011 | Haas et al. | 701/19 |
| 2012/0116616 | A1 | 5/2012 | Morris | |

OTHER PUBLICATIONS

Thomas J. Keller, "Petition for Rulemaking of the Association of American Railroads", Oct. 2007.*

"Cowtrack™ Long Range RFID locating system (RTLS)", found on www.trolleyscan.com/cowtrack.html possibly on or about Jan. 16, 2012; 2 pages.

Invitation to Pay Additional Fees for international application No. PCT/US2014/018192, dated Mar. 25, 2014 (2 pages).

International Search Report for International Application No. PCT/US2014/018192, dated May 19, 2014 (6 pages).

Written Opinion of the International Searching Authority for International Application No. PCT/US2014/018192, dated May 19, 2014 (6 pages).

* cited by examiner

TRAIN INTEGRITY AND END OF TRAIN LOCATION VIA RF RANGING

FIELD

This disclosure relates to the field of positive train control systems and increasing safety in such systems.

BACKGROUND

Positive train control (PTC) systems are currently under development in the U.S. and elsewhere. In a PTC system in the U.S., positive knowledge of the location of the end of the train is required since trains must maintain positive length of train awareness. So an accurate, positive measure a train's length (and hence location of the train end) is desirable. Without such a capability, track occupancy circuits will have to be maintained and even expanded from their current density (i.e. more per route mile) in order to shorten headways between trains on a given track segment. Shortening headways between successive trains is one of the operational benefits of migrating from current signal based systems to a PTC system which can allow for more traffic routing and traffic flow flexibility in planning and scheduling.

U.S. Patent Application Publication 2012/0116616 describes a method that continually determines the length of a train operating in a PTC environment. The method uses a line-of-sight vector distance between each end of the train, together with data from an on-train track database, to determine train length.

SUMMARY

Systems and methods are described that can be used in a PTC system to continuously monitor train integrity and end of train location using radio frequency (RF) ranging techniques. The described systems and methods allow PTC controlled trains to maintain positive length of train awareness and to determine if a portion of the train separates unintentionally.

The described systems and methods can be implemented on existing RF infrastructure used on trains, without impacting existing messaging traffic, adding bandwidth or power requirements. Alternatively, the described systems and methods can be used on future RF infrastructures that may be designed for or employed on trains.

The described systems and methods work on stretched trains running on tangent or straight track, as well as on foreshortened trains running on curved track.

The line of sight (LOS) distance between the head end and the end of the train is determined via RF ranging, which is then used to compared to an expected distance, for example an expected distance calculated mathematically such as by using the techniques described in U.S. Patent Application Publication 2012/0116616 which is incorporated herein by reference in its entirety.

In one embodiment, the RF ranging is based on existing Association of American Railroads licensed RF end of train (EOT) infrastructure and RF emissions. EOT devices are currently used to send brake pipe pressure signals to the head end of the train (HOT) using RF signals. Existing EOT devices can be modified to implement the RF ranging techniques described herein or specially designed EOT devices can be utilized.

There is a mathematical relation between the LOS distance and the geographical coordinates of the HOT and the EOT. The geographical coordinates of the HOT are known via one or more GPS devices at the HOT and by the location determination unit or system (LDS) at the HOT. Therefore, in another embodiment, once the LOS distance is determined, the geographical coordinates of the EOT can be calculated.

In another embodiment, the RF ranging used is one-way ranging, for example from the HOT to the EOT or from EOT to HOT, based on a time of transmission-time of arrival principal. This helps to reduce measurement biases, measurement noise, and total power utilized. The RF ranging is determined based on the time it takes for the RF signal to travel from the HOT to the EOT (or alternatively from the EOT to the HOT) and the velocity factor or wave propagation speed of the signal in air (which is estimated to be about 99.77% the speed of light), adjusted, if necessary, for any clock biases between clocks at the HOT and the EOT.

In another embodiment, an exemplary method of monitoring train integrity includes sending an RF transmission from the HOT device to the EOT device. Receipt of the transmission is logged at the EOT device. Once the entire transmission is received by the EOT device, the EOT device creates a time stamp and sends a transmission back to the HOT device with the time stamp. The HOT device then computes the time difference, computes the train length, and compares the computed train length to the expected train length.

The expected train length can be determined in any suitable manner. For example, the techniques described in U.S. Patent Application Publication 2012/0116616 employing a track database can be used.

In one embodiment, an end of train device used in determining train length includes electronics that monitor one or more of brake pipe pressure, motion status, battery condition and marker light status, an RF transceiver, and a phase lock loop (PLL) counter and event timer.

DRAWINGS

Figure 3:
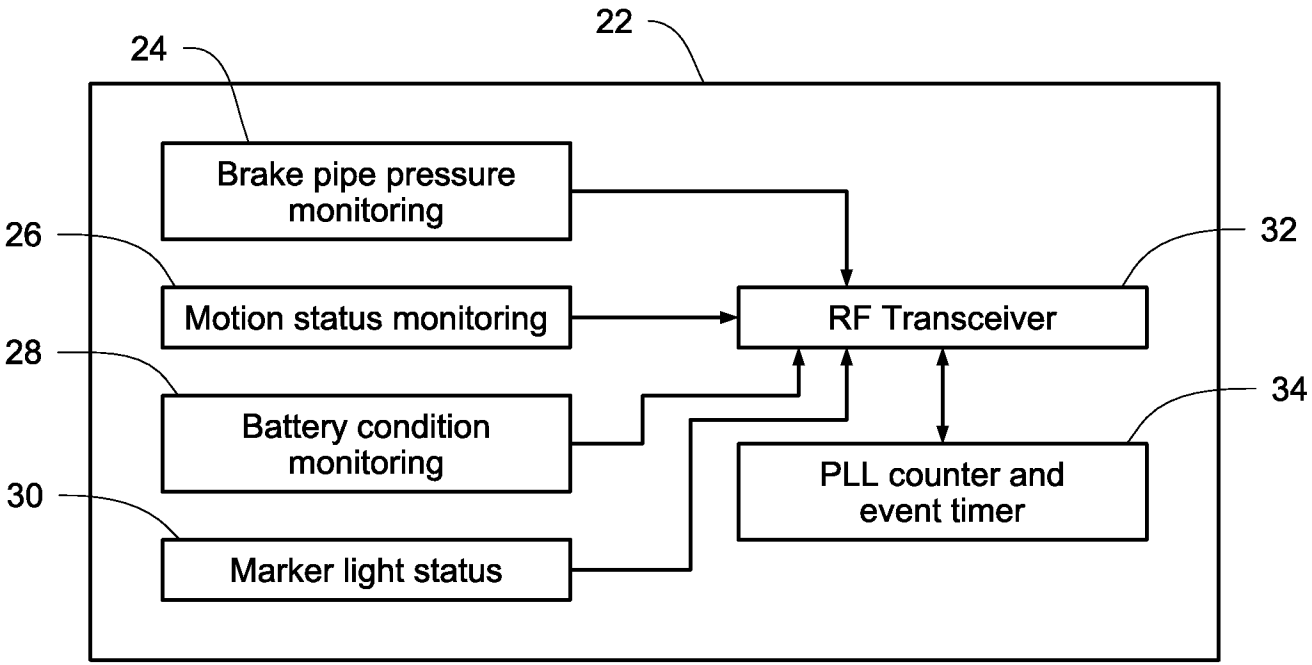

FIG. 3 schematically depicts an EOT device used in the described system and method.

Figure 4:
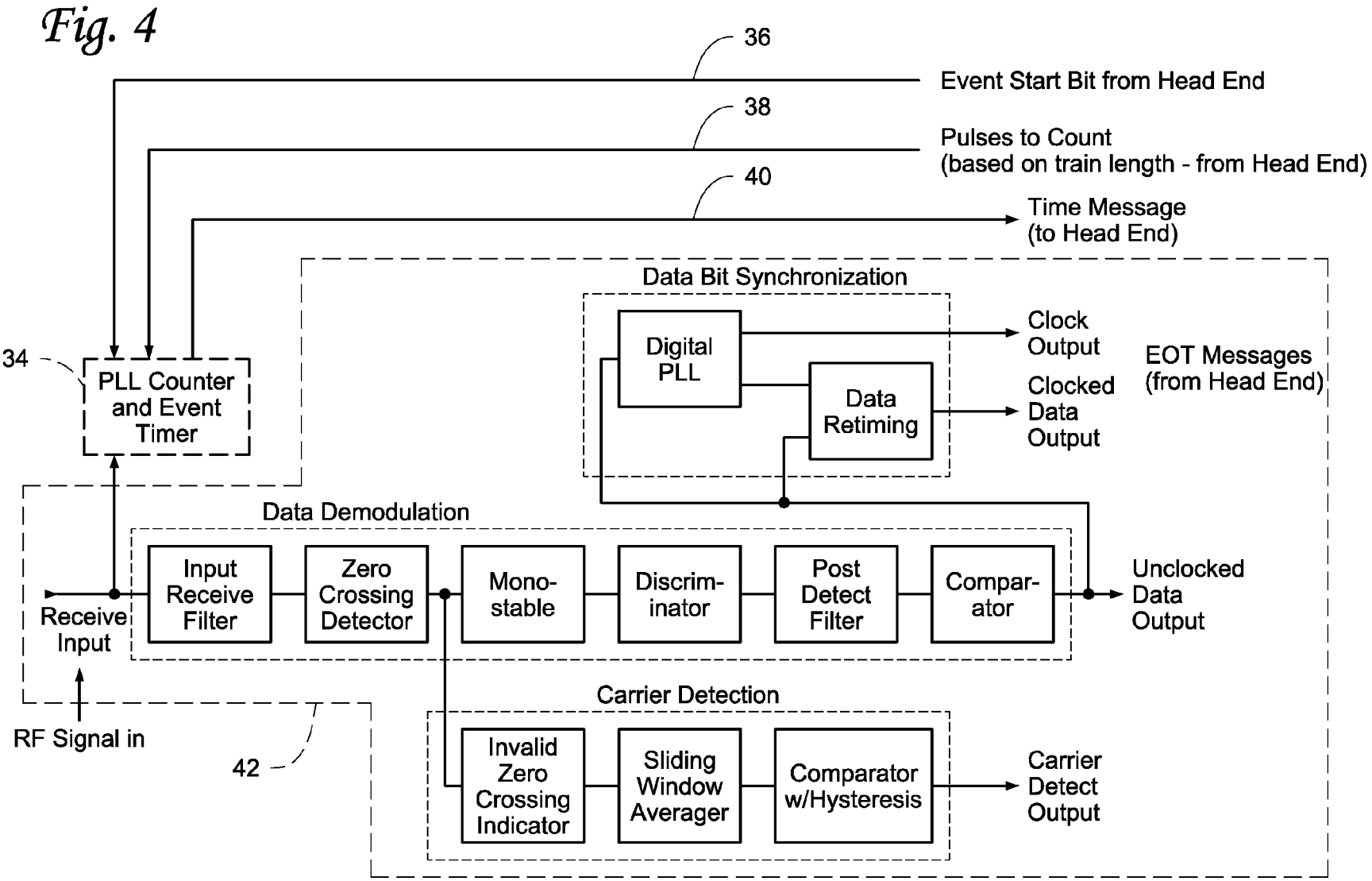

FIG. 4 illustrates some of the electronics within the EOT device of FIG. 3.

Figure 5:
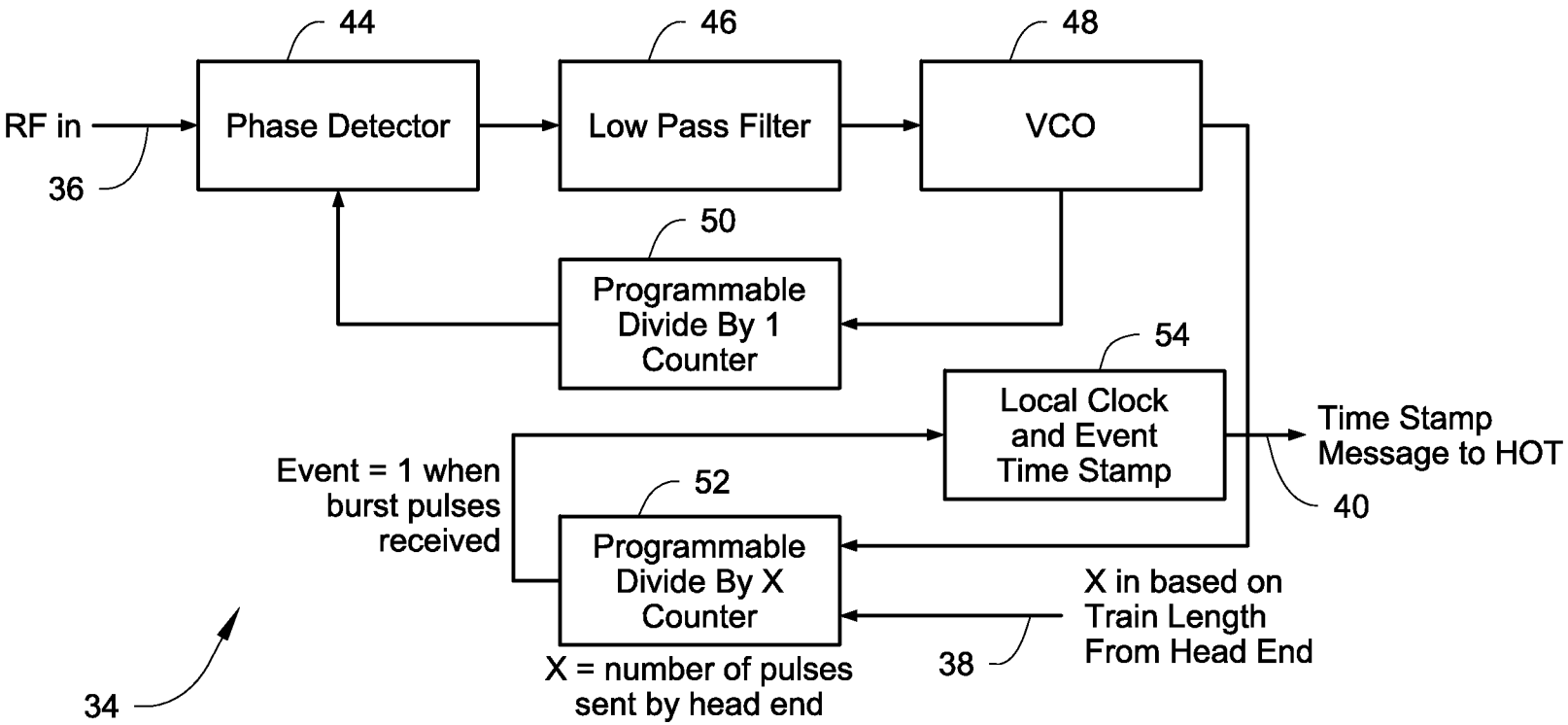

FIG. 5 illustrates the PLL counter and event timer in the EOT device.

Figure 6:
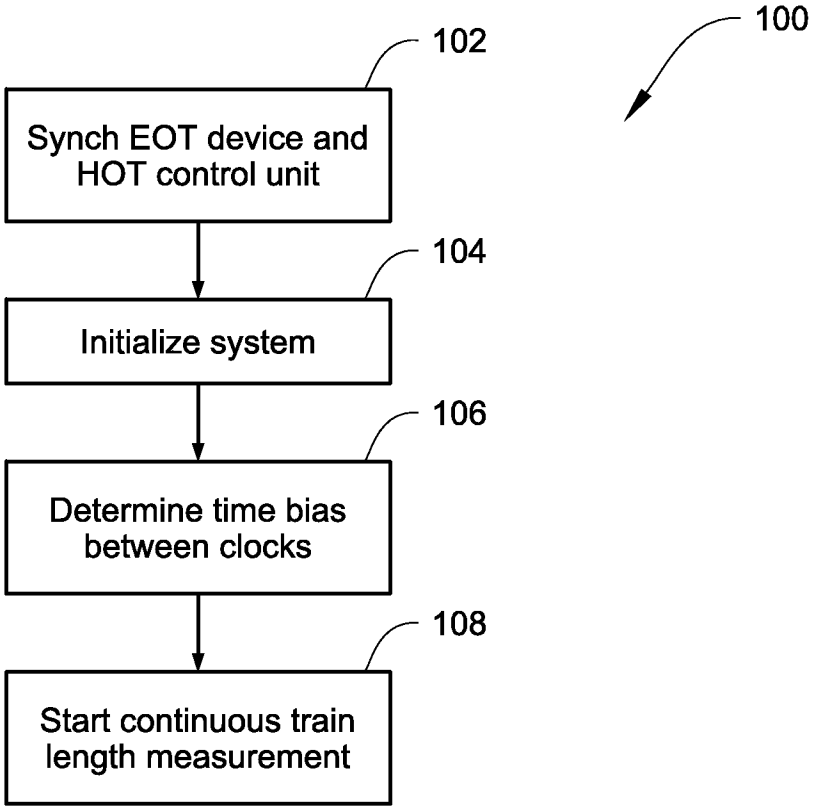

FIG. 6 depicts a process flow of the train length measurement process described herein.

DETAILED DESCRIPTION

Figure 1:
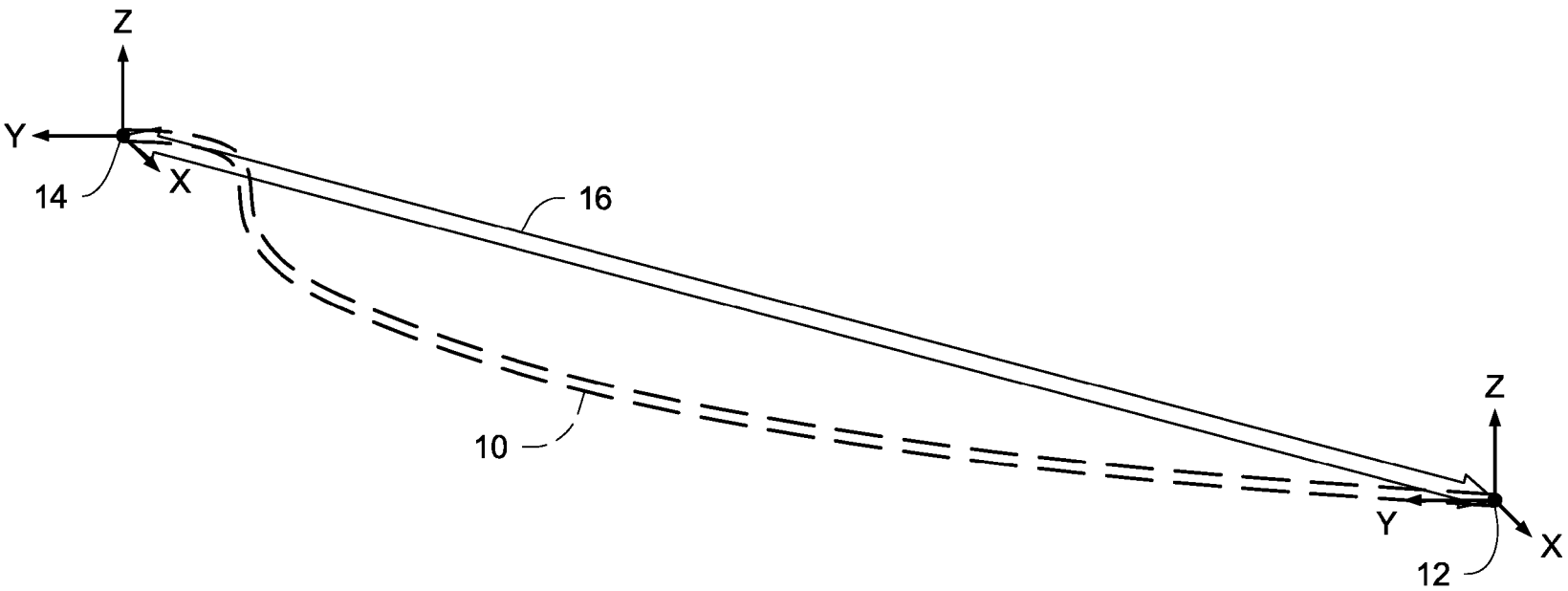
FIG. 1 is a schematic depiction of concepts involved in monitoring train integrity and end of train location.

FIG. 1 schematically depicts some of the geometry involved in continuously monitor train integrity and end of train location using radio frequency (RF) ranging. A train 10 is illustrated running on curved track. The head end 12 of the train (or HOT) is located at certain Earth-Centered, Earth-Fixed (ECEF) coordinates X, Y, Z while the end of train 14 (or EOT) is located at its own ECEF coordinates X, Y, Z. The train 10 has a known physical length measured between the HOT 12 and the EOT 14. However, because the train is running on curved track, the train is foreshortened so that the straight line distance or line of sight (LOS) vector distance 16 between the HOT 12 and the EOT 14 is less than the actual physical length. If the train were running on straight track, the LOS vector distance 16 would be equal to the actual physical length of the train.

U.S. Patent Application Publication 2012/0116616 describes how the length of the train can be continuously mathematically determined using data contained in a track database together with certain sensor data. U.S. Patent Application Publication 2012/0116616 is incorporated herein by reference in its entirety.

Figure 2:
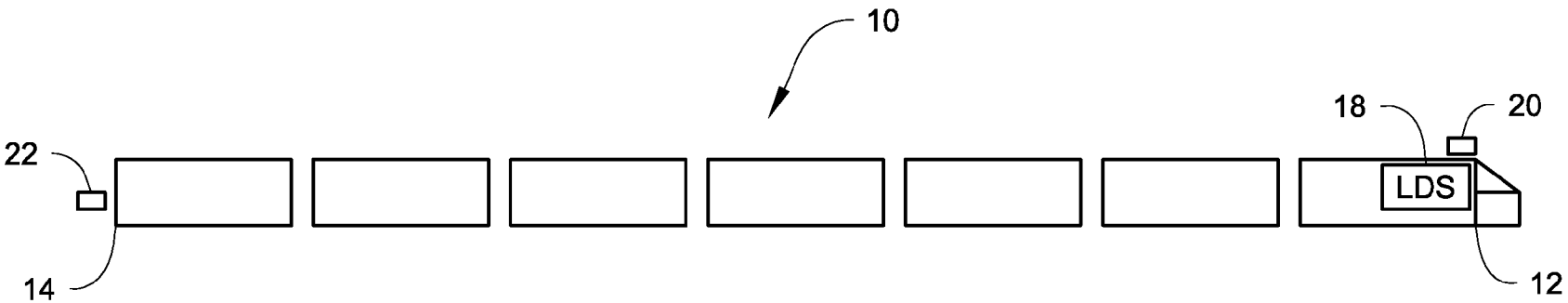
FIG. 2 depicts a side view of a train showing the HOT and EOT.

FIG. 2 illustrates a side view of the train 10. The train can include any number of cars and have any length depending upon the number of cars that make up the train. In this example, the train 10 includes a locomotive at the HOT 12. The locomotive includes a HOT control unit 18 that contains a location determination unit or system (LDS) as described in U.S. Patent Application Publication 2012/0116616. The LDS contains the track database which is used to calculate the length of the train using the track database. The HOT control unit 18 also includes an RF transceiver 20 that is used to communicate with an EOT device 22 at the EOT 14.

The HOT control unit 18 is configured to generate the LOS distance 16 calculations at pre-determined time intervals, as well as create logs with time stamps as discussed further below.

The LOS distance 16 between the head end 12 and the end of train 14 is determined by the following equation:

$$\text{LOS distance}=A\times B,$$

where A is the one-way transit time for the RF signal to travel between the head end 12 and the end of train 14; and where B is velocity factor or rate of propagation of the RF signal. The propagation rate of an RF signal in air is typically a constant of around 99.77% of the speed of light; however the propagation rate can be specifically determined based on initial field testing.

As discussed in further detail below, the one-way transit time needs to be determined which is then multiplied by the velocity factor to obtain the LOS distance. The LOS distance is then compared to an expected distance which can be, for example, calculated using the technique described in U.S. Patent Application Publication 2012/0116616.]

Before discussing the details of how to measure the LOS distance 16 using RF ranging, some details of the EOT device 22 will be described with respect to FIGS. 3-5. In general, there are many different types of EOT devices known in the art and their general construction and operation are well known in the art. Known EOT devices monitor critical last car information including, but not limited to, one or more of brake pipe pressure 24, motion status 26, battery condition 28 and marker light status 30, and communicates this information to the HOT control unit 18 using radio communications via an RF transceiver 32.

However, the EOT device 22 described herein also includes a PLL counter and event timer 34 that is also in communication with the RF transceiver 32. As shown in FIG. 4, the PLL counter and event timer 34 is configured to receive an event start bit 36 from the HOT control unit 18 as well as cycles to count 38 from the HOT control unit 18. The PLL counter and event timer 34 is also configured to generate a signal 40 containing a time stamp indicating when the last cycle was received. Although FIG. 4 shows the PLL counter and event timer 34 as a single integral physical unit, the cycle counting and time stamp functions can be performed in separate physical units separate from one another. In addition, the electronics illustrated in the dashed line box 42 are standard electronics used on conventional EOT devices.

FIG. 5 illustrates details of an exemplary implementation of the PLL counter and event timer 34. In this example, the RF signal is received by a phase detector 44 whose output is communicated to a low pass filter 46 which in turn outputs to a voltage controlled oscillator 48. The oscillator 48 also loops back to the phase detector 44 via a programmable divide by 1 counter 50 which counts the number of cycles received.

In addition, the number X of pulses 38 sent by the HOT control unit 18 is input into a programmable divide by X counter 52 whose output is directed to a local clock and event time stamp device 54 which time stamps when the EOT device 22 receives the last cycle from the HOT control unit 18 and sends the time stamp signal 40 to the HOT control unit 18.

With reference now to FIG. 6, an exemplary process flow of the train length measurement process 100 is illustrated. In describing the exemplary process 100, the process will be described as employing AAR Standard S-5701 communication protocol which is used in current EOT device transmissions with the HOT control unit. AAR Standard S-5701 uses coherent phase frequency shift keyed (CPFSK) modulation of the RF transmissions at a frequency of 457 MHz, a baud rate of 2400 bps, and maximum 64 bit data packets. However, discussion of the AAR Standard S-5701 communication protocol is for convenience only, and any RF FM communication protocol can be used between the EOT device 22 and the HOT control unit 18.

The process 100 begins by initially synchronizing 102 the EOT device 22, in particular the PLL counter and event timer 34, and the HOT control unit 18, to a specific burst pulse. At this time, the train is not moving and the train crew is in the process of confirming the train length before moving the train.

Synchronizing is necessary because the system needs to identify which RF burst from the HOT transceiver 20 is the one the PLL counter and event timer 34 needs to count cycles in and report when complete using the time stamp message 40.

Assume a sampling rate of every 2.4 seconds over the 2400 bps modulation signal. There are 2400 possible RF states (1/0 transitions in non-return to zero level) per second, which in a 2.4 second sampling window, equals 5760 pulse states. The HOT and EOT device both need to know which 1 out of the 5760 pulses is the reference set to measure transmit-receipt time delays with.

During synchronizing, the HOT control unit 18 temporarily suspends normal HOT-EOT message traffic and sends a 1/0 data pattern at 2400 bit/sec to the EOT device while time stamping each burst internally. The EOT device time stamps one of the received bursts with the time received, and then transmits that back to the HOT. The HOT computes an initial time difference value. In the event that the time stamped reference set was not identified properly by the EOT device on the first try (there is a 1 out of 5760 chance), the HOT control unit then shifts it's 1 of every 5760 measurement reference bursts by one RF (1/0) state.

Once the EOT device and the HOT control unit are synchronized to recognize the same RF burst (1 of every 5760 at 2.4 second sampling rate for data), system initialization 104 commences. In addition, once synchronized, the HOT control unit reverts back to 64 bit time stamping every 5760th RF cycle, the I/0 data pattern from the HOT control unit stops and normal railroad EOT-HOT messaging, such as brake pipe pressure and train motion status signals, resumes, the HOT control unit sends an initialization confirmation to the EOT device (i.e. the event/measurement start bit 36), the EOT goes back to 64 bit time stamping and time stamps every 5760th RF burst and sends time stamp message to the HOT control unit.

During system initialization 104, the train is still not moving and the train crew is in the process of confirming the train length before moving the train. During initialization, the HOT control unit uses the stretched train length to determine the approximate number of RF cycles of the 457 MHz carrier frequency that exist from the head end 12 to the end of train 14. For example, for a 10,000 foot train, there are 4653 carrier cycles.

The number of RF cycles in a single burst is then determined by taking a fraction of the number of carrier cycles. In one embodiment, the fraction could be 50% (or 2326 cycles). The fraction selected could be higher or lower than this number. However, a larger fraction, and thus a larger number of cycles, produces a better result. The selected fractional number of cycles is then sent to the EOT device 22 which loads the RF counter 52 which will go high once the number of pulses received equals the countdown set value received from the HOT control unit.

The HOT control unit 18 then emits a burst of 2326 cycles of RF. The HOT control unit time stamps when the last cycle of RF burst is emitted as accumulated counter reaches 2326 cycles. In one embodiment, the HOT control unit uses the same PLL counter and event timer mechanism as employed on the EOT device (i.e. mechanism 34).

The EOT device's 22 PLL, formed by the elements 44, 46, 48 and 50, is then phase locked to the HOT carrier frequency. During use, the EOT device counts up that number of RF cycles (e.g. 2326), and when that number is reached, the EOT device marks that event with EOT clock 54 local time indicating when the last full cycle was received from the last burst. The EOT device then sends that time stamp back to the HOT control unit as the data message 40 along with the burst cycle count.

The HOT control unit receives the data message 40 containing the cycle count and time stamp from the EOT device. The HOT control unit confirms that the proper number of cycles was captured by the EOT device. The HOT control unit also differences the two time stamps, i.e. the time stamp of the HOT control unit when the last cycle is emitted and the time stamp of the EOT device in the data message 40. If the local clocks of the EOT device and the HOT control unit are perfectly synched, then the time difference between the end of the HOT control unit emitting and the EOT device's time to receive the full number of cycles would equal the RF one way transit time between the head end 12 and the end of train 14. Assuming the 10,000 foot train in the example above and the 99.77% velocity factor, the transmit time in that example is about 10.2131 μsec.

In one embodiment, during the initialization 104, it can be assumed that the time clocks in the EOT device and the HOT control unit have the same approximate drift rate, or the drift rates are close enough for the short measurement period interval. If the drifts between the two clocks are too high, then the initialization will have to be repeated more often to ensure that the biases are nulled out. It is believed at this time that a drift of $1\times10^{-9}$ seconds per day for each clock, which allows for about a 1.0 foot build-up of time bias over 24 hours, provides adequate performance.

The system initialization 104 discussed above assumed that the local clocks are perfectly synched. However, in the event that they are not synched, the train length calculation accuracy can be enhanced by factoring in any residual clock/time bias between the EOT device clock and the HOT control unit clock. To accomplish this, the time bias between the clocks needs can be determined in step 106.

In the time bias determination step 106, the HOT control unit calculates, based on the known length of the train and the assumed 99.77% velocity factor, that it takes a first estimated time to receive all pulses sent. For example, for sake of example, assume that the first estimated time is about 1.1 seconds. During system initialization 104, the HOT control unit receives the data message 40 from the EOT device that the time was 1.2 seconds when the EOT device counted the last pulse from that burst. The HOT control unit then subtracts the estimated propagation delay of 1.1 seconds from the EOT time stamp of 1.2 seconds (i.e. $1.2\times1.1=0.1$) and determines that the clock bias between the HOT control unit and the EOT device is +0.1 seconds. This clock bias estimate can then be removed from all time stamp reports from the EOT device. To better estimate the clock bias, multiple consecutive measurement cycles can be used and averaged with each other to estimate the time bias.

The time bias determination step 106 is optional and can be eliminated altogether. For example, the EOT device 22 can include a GPS unit which will include precise clock time via GPS satellites. The HOT control unit 18 also includes a GPS unit from which the clock time is derived, so that the clocks in the EOT device and the HOT control unit will be synchronized via GPS. If GPS is used on the EOT to disciple the clock to the GPS time on the HOT, it would only have to be performed at initialization of the system if the EOT local clock drift is small, for example less than $50\times10^{-9}$ seconds per day. In this case, the transit time of the RF signals between head end 12 and the end of train 14 is now a function of RF propagation delay only.

Once the train crew has confirmed the train length, the train is now ready to move, and the process 100 can start a continuous or repetitive train length measurement process 108. The measurement process 108 begins at a predetermined interval based on the CPFSK Baud Rate at the start of the CPFSK baud cycle. At the exemplary 2400 Baud rate, the raw measurement process can occur every 5760th bit transition time, or once every 2.4 seconds.

Based on the expected nominal value of the RF transit time between the head end and the end of train, shorter time differences are converted into train end-to-end range measurements directly by the HOT control unit. These are compared with the predicted values on a continual time averaged basis.

These determined range results are continually compared with geometric ranges calculated using the LDS unit using offset into partition, the end of train offset, and the track database parameters as described in U.S. Patent Application Publication 2012/0116616.

If the range differences show a zero mean value, with only the train length variance due to buff and draft forces through the train creating off nominal RF based length changes, then the train's integrity can be assured. The variances will also be monitored by software and an automatic alarm will alert the crew of out of range conditions. The difference between the expected range and the measured range will be displayed to the crew operating the train on a continual basis, and be logged for possible communication to the centralized control center.

If the RF determined length increases beyond expected bounds, it can be assumed that the train has separated and an alarm will notify the operating crew. In a train separation case, the LOS RF determined length can be used, while within radio range of the HOT control unit, to determine directly, with the underlying track database, the coordinates of the EOT device, identifying the location at the rear of the last part of the train on the track. As long as the HOT and EOT are still communicating, the computed EOT coordinate is available to the crew and possible relay to the centralized control center, for traffic safety and recovery operations.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An end of train device, comprising:

a radio frequency transceiver that utilizes coherent phase frequency shift keyed modulation of radio frequency transmissions;

at least one mechanism that monitors last car information and that is in communication with the radio frequency transceiver;

a PLL counter and event timer in communication with the radio frequency transceiver, the PLL counter and event timer includes a radio frequency counter configured to count the number of cycles received in a radio frequency signal, a clock and a time stamp device.

2. The end of train device of claim 1, wherein the at least one mechanism is configured to monitor brake pipe pressure, last car motion status, battery condition, or marker light status.

3. The end of train device of claim 2, comprising a plurality of the mechanisms that monitor last car information and that are each in communication with the radio frequency transceiver, the plurality of mechanisms include a brake pipe pressure monitor, a motion status monitor, a battery condition monitor, and a marker light monitor.

4. The end of train device of claim 1, wherein the radio frequency transmissions are at a frequency of 457 MHz.

5. The end of train device of claim 1, wherein the clock and the time stamp device are configured to generate a signal containing a time stamp that indicates when the last cycle in the radio frequency signal was received.

6. A system, comprising:

an end of train device mounted at an end car of a train, the end of train device includes:

a radio frequency transceiver that utilizes coherent phase frequency shift keyed modulation of radio frequency transmissions;

at least one mechanism that monitors last car information and that is in communication with the radio frequency transceiver;

a PLL counter and event timer in communication with the radio frequency transceiver, the PLL counter and event timer includes a radio frequency counter configured to count the number of cycles received in a radio frequency signal, a clock and a time stamp device; and a head of train control unit mounted at a head end of the train, the head of train control unit includes a head end radio frequency transceiver that utilizes coherent phase frequency shift keyed modulation of radio frequency transmissions.

7. The system of claim 6, wherein the head of train control unit includes a PLL counter and event timer in communication with the head end radio frequency transceiver, the PLL counter and event timer in the head of train control unit is identical to the PLL counter and event timer in the end of train device.

8. The system of claim 6, wherein the at least one mechanism is configured to monitor brake pipe pressure, last car motion status, battery condition, or marker light status.

9. The system of claim 8, comprising a plurality of the mechanisms that monitor last car information and that are each in communication with the radio frequency transceiver, the plurality of mechanisms include a brake pipe pressure monitor, a motion status monitor, a battery condition monitor, and a marker light monitor.

10. The system of claim 6, wherein the radio frequency transmissions of the end of train device are at a frequency of 457 MHz.

11. The system of claim 6, wherein the clock and the time stamp device are configured to generate a signal containing a time stamp that indicates when the last cycle in the radio frequency signal was received.

12. A process of determining line of sight distance between a head end of a train and an end of the train, comprising:

sending a radio frequency transmission between the head end and an end of train device at the end of the train utilizing coherent phase frequency shift keyed modulation of the radio frequency transmission;

determining the one way propagation time of the radio frequency transmission between the head end and the end of train device;

multiplying the determined one way propagation time by the propagation speed of the radio frequency transmission to determine the line of sight distance;

the end of train device counting the number of cycles received in the radio frequency transmission; and the end of train device sending a radio frequency transmission back to the head end utilizing coherent phase frequency shift keyed modulation of the radio frequency transmission, the radio frequency transmission sent by the end of train device includes a time stamp of when the last cycle of the radio frequency transmission from the head end was received and a count of the number of cycles received.

13. The process of claim 12, further comprising the head end determining the line of sight distance using the radio frequency transmission from the end of train device.

14. The process of claim 13, further comprising the head end comparing the determined line of sight distance to an expected line of sight distance.

15. The process of claim 12, wherein the head end determines a time difference between the one way propagation time of the radio frequency transmission from the head end to the end of train device and the one way propagation time of the radio frequency transmission from the end of train device to the head end.

16. The process of claim 12, prior to sending the radio frequency transmission, synchronizing the end of train device and a head end control unit at the head end, initializing the end of train device and the head end control unit, and determining a time bias between a clock of the end of train device and a clock of the head end control unit.

17. The process of claim 12, wherein the radio frequency transmissions of the end of train device are at a frequency of 457 MHz.

18. A process of determining line of sight distance between a head end of a train and an end of the train, comprising:

sending a radio frequency transmission between the head end and an end of train device at the end of the train utilizing AAR Standard S-5701 communication protocol;

determining the one way propagation time of the radio frequency transmission between the head end and the end of train device;

multiplying the determined one way propagation time by the propagation speed of the radio frequency transmission to determine the line of sight distance;

the end of train device counting the number of cycles received in the radio frequency transmission; and the end of train device sending a radio frequency transmission back to the head end utilizing coherent phase frequency shift keyed modulation of the radio frequency transmission, the radio frequency transmission sent by the end of train device includes a time stamp of when the last cycle of the radio frequency transmission from the head end was received and a count of the number of cycles received.

* * * * *